US009068466B2

(12) United States Patent
Stiehler et al.

(10) Patent No.: US 9,068,466 B2
(45) Date of Patent: Jun. 30, 2015

(54) SEALING DEVICE, INTEGRALLY BLADED ROTOR BASIC BODY, AND TURBOMACHINE

(75) Inventors: Frank Stiehler, Bad Liebenwerda (DE); Manuel Hein, Karlsfeld (DE)

(73) Assignee: MTU Aero Engines GmbH, Munich (DE)

( * ) Notice: Subject to any disclaimer, the term of this patent is extended or adjusted under 35 U.S.C. 154(b) by 600 days.

(21) Appl. No.: 13/461,402

(22) Filed: May 1, 2012

(65) Prior Publication Data

US 2012/0282098 A1 Nov. 8, 2012

(30) Foreign Application Priority Data

May 2, 2011 (EP) ..... 11164416

(51) Int. Cl.

| | |
|---|---|
| ***F01D 11/00*** | (2006.01) |
| ***F01D 5/16*** | (2006.01) |
| ***F01D 5/22*** | (2006.01) |
| ***F01D 5/34*** | (2006.01) |

(52) U.S. Cl.

CPC ..... *F01D 11/006* (2013.01); *F01D 5/16* (2013.01); *F01D 5/22* (2013.01); *F01D 5/34* (2013.01); *F05D 2240/55* (2013.01); *F05D 2260/96* (2013.01)

(58) Field of Classification Search

CPC ..... F01D 5/16; F01D 5/22; F01D 5/26; F01D 5/34; F01D 11/006; F01D 11/008; F05D 2260/96; F05D 2240/55

USPC ..... 416/234, 190, 191, 193 R, 193 A, 239, 416/248, 500

See application file for complete search history.

(56) References Cited

U.S. PATENT DOCUMENTS

| | | | | |
|---|---|---|---|---|
| 3,751,183 | A | 8/1973 | Nichols et al. | |
| 5,143,517 | A | 9/1992 | Vermont | |
| 5,573,375 | A * | 11/1996 | Barcza | 416/193 A |
| 6,932,575 | B2 * | 8/2005 | Surace et al. | 416/193 A |
| 7,121,800 | B2 * | 10/2006 | Beattie | 416/190 |
| 2011/0255991 | A1 | 10/2011 | Borufka et al. | |

FOREIGN PATENT DOCUMENTS

| | | | | |
|---|---|---|---|---|
| CH | 698 921 | B1 | 12/2009 | |
| CH | 698921 | B1 * | 12/2009 | F01D 11/00 |
| DE | 10 2007 037 208 | A1 | 2/2009 | |
| DE | 10 2009 007 468 | A1 | 8/2010 | |
| DE | 10 2009 011 879 | A1 | 9/2010 | |
| DE | 10 2009 011 965 | A1 | 9/2010 | |
| GB | 2 016 092 | A | 9/1979 | |
| GB | 2 344 383 | A | 6/2000 | |
| WO | WO 2010 099 783 | A1 | 9/2010 | |

* cited by examiner

*Primary Examiner* — Dwayne J White
*Assistant Examiner* — William Grigos
(74) *Attorney, Agent, or Firm* — Davidson, Davidson & Kappel, LLC

(57) ABSTRACT

A sealing device for an integrally bladed rotor basic body of a turbomachine to suppress a gas exchange between a hot gas stream and a cooling air stream in the radial direction in contact areas of adjacent moving blades, including a plurality of sealing elements activatable by centrifugal force, which may be situated in the area of channels which extend from a high-pressure side to a low-pressure side and are peripherally delimited by the moving blades, an integrally bladed rotor basic body having such a sealing device, and a turbomachine having such an integrally bladed rotor basic body.

13 Claims, 5 Drawing Sheets

SEALING DEVICE, INTEGRALLY BLADED ROTOR BASIC BODY, AND TURBOMACHINE

This claims the benefit of European Patent Application EP 111 644 16,7, filed May 2, 2011 and hereby incorporated by reference herein.

The present invention relates to a sealing device for an integrally bladed rotor basic body, an integrally bladed rotor body having such a sealing device, and a turbomachine.

BACKGROUND

Integrally bladed rotor main bodies for turbomachines such as aircraft engines including a plurality of moving blades, which are attached in an integrally joined manner to a disk-shaped or ring-shaped basic body and form a blade row, typically have a channel-type passage between blade roots or blade shafts of adjacent moving blades for manufacturing reasons, through which cooling air may flow in the axial direction from the high-pressure side to the low-pressure side. In order to prevent a gas exchange in the radial direction between a ring-shaped-side hot gas stream and the cooling air stream directed through the channels in the lateral contact areas of the moving blades, sealing elements are fixed in place therein using a press fit or an integrally joined connection as disclosed, for example, in DE 10 2009 007 468 A1. The production of the press fit or the integrally joined connection is comparatively complex technically and with respect to time, however. In particular, removal in the event of replacement of the sealing elements is time-consuming.

SUMMARY OF THE INVENTION

It is an object of the present invention to provide a sealing device for an integrally bladed rotor basic body of a turbomachine, which remedies the above-mentioned disadvantages and allows simple installation and removal of sealing elements. Furthermore, it is an alternate or additional object of the present invention to provide an integrally bladed rotor basic body for a turbomachine having an optimized sealing device and a turbomachine.

A sealing device according to the present invention for an integrally bladed rotor basic body of a turbomachine for suppressing a gas exchange between a hot gas stream and a cooling air stream in the radial direction in lateral contact areas of adjacent moving blades has a plurality of sealing elements. According to the present invention, the sealing elements are activatable by centrifugal force and may each be situated in the area of channels which extend from a high-pressure side to a low-pressure side and are peripherally delimited by the moving blades.

Because the sealing elements are activatable by centrifugal force, their technically and chronologically complex installation is omitted, since they are positioned in the contact areas so they are movable in the radial direction or are loose. In addition, their removal or replacement in the event of damage is made substantially easier. Furthermore, the sealing elements may be optimized with respect to material, because they are no longer to be attached in an integrally joined, friction-locked, or similar manner to the moving blades and therefore do not have to have an appropriate material composition suitable for welding or a press fit. Because the sealing elements may be situated in the area of the channels or in the channels, installation in moving blade areas having high stability is made possible.

In one exemplary embodiment, the sealing elements each have a rectangular cross section having a level sealing surface extending in the longitudinal direction. Such sealing elements may be easily produced and may be easily positioned in the contact areas in particular, because they are tension-free and therefore cannot jam.

In another exemplary embodiment, the sealing elements have head-side sealing surfaces tilted like a roof toward one another in the transverse direction, whereby a reliable contact in the particular contact area is made possible and a high level of sealing action or seal is achieved. Alternatively, the sealing surfaces tilted toward one another may also form a sealing surface which is curved viewed in the transverse direction.

The sealing action may be improved if the sealing surfaces are curved concavely, i.e., outward, in the longitudinal direction.

The sealing action may additionally be improved if the sealing elements are elastically deformable under the application of centrifugal force.

The sealing elements may either be situated in integral receptacles on the contact area side or, however, in a movable manner having at least one body section in each case in a support body produced separately from the moving blades in the contact areas. The support bodies may be individually designed and also installed later.

In one exemplary embodiment, the support bodies are axial sealing bodies, so that an axial cooling air stream through the contact areas may be at least reduced, whereby the radial sealing elements may be relieved.

An integrally bladed rotor basic body according to the present invention for a turbomachine has a plurality of moving blades and has a sealing device according to the present invention including a plurality of sealing elements activatable by centrifugal force for suppressing a gas exchange between a hot gas stream and a cooling air stream in the radial direction in contact areas of adjacent moving blades, the sealing elements each being situated in the area of channels, which extend from a high-pressure side to a low-pressure side and are peripherally delimited by the moving blades.

Such a rotor basic body is distinguished by quiet running behavior, since the masses of the moving blades in the contact area are more or less not influenced by the sealing elements activated by centrifugal force, and therefore no or almost no reactions on the oscillation mechanism of the moving blades occur due to the sealing elements. Because the sealing elements are situated in direct proximity to the cooling air stream, the cooling air stream is prevented from being able to penetrate between the moving blades into other spaces on the contact area side. Furthermore, the positioning close to the rotational axis also has a positive effect on the running behavior.

In one exemplary embodiment, the sealing elements are accommodated in channel walls in each case in a pocket, which is formed by opposing depressions or slots of adjacent moving blades and extends parallel to the channel axis. The pockets are simple to produce in terms of manufacturing technology and allow, because of their linear course, simple installation and removal of the sealing elements and tension-free positioning of them. The depressions may be easily introduced into the moving blades, for example, with the aid of electrochemical processing (ECM/PECM).

The pockets may each have a radial internal opening and a radial external base. In this way, the sealing elements are pressed in the pockets against the base during operation, whereby they are prevented from falling out.

In order to prevent the sealing elements from falling out of the pockets at a standstill, a securing device may be situated in the area of the opening.

In one exemplary embodiment, the securing device has a securing element extending in the peripheral direction as an axial stop for the sealing elements and a clamping element which extends in the peripheral direction and fixes the securing element. In this way, all sealing elements may be secured by only two components—a securing element and a clamping element—whereby the securing device is simple to install and is weight-optimized.

In particular, it is advantageous if the securing element is inserted with a curved end section into an inner peripheral groove formed by the moving blades and is fixed in place therein via the clamping element, so that the clamping element is pressed against the end section during a rotation and in this way loosening of the securing element during operation is prevented.

In one exemplary embodiment, the sealing elements are each situated directly in the channels via a support body, which may additionally act as the axial sealing bodies.

A turbomachine according to the present invention has at least one integrally bladed rotor basic body according to the present invention and is distinguished by a high delimitation of a hot gas stream from a cooling air stream in the radial direction, by quiet running behavior, and by high maintenance friendliness with respect to radial sealing elements on the rotor-blade side.

Other advantageous exemplary embodiments of the invention are the subject matter of further subclaims.

BRIEF DESCRIPTION OF THE DRAWINGS

Preferred exemplary embodiments of the present invention are explained in greater detail hereafter on the basis of schematic illustrations.

DETAILED DESCRIPTION

Figure 1:
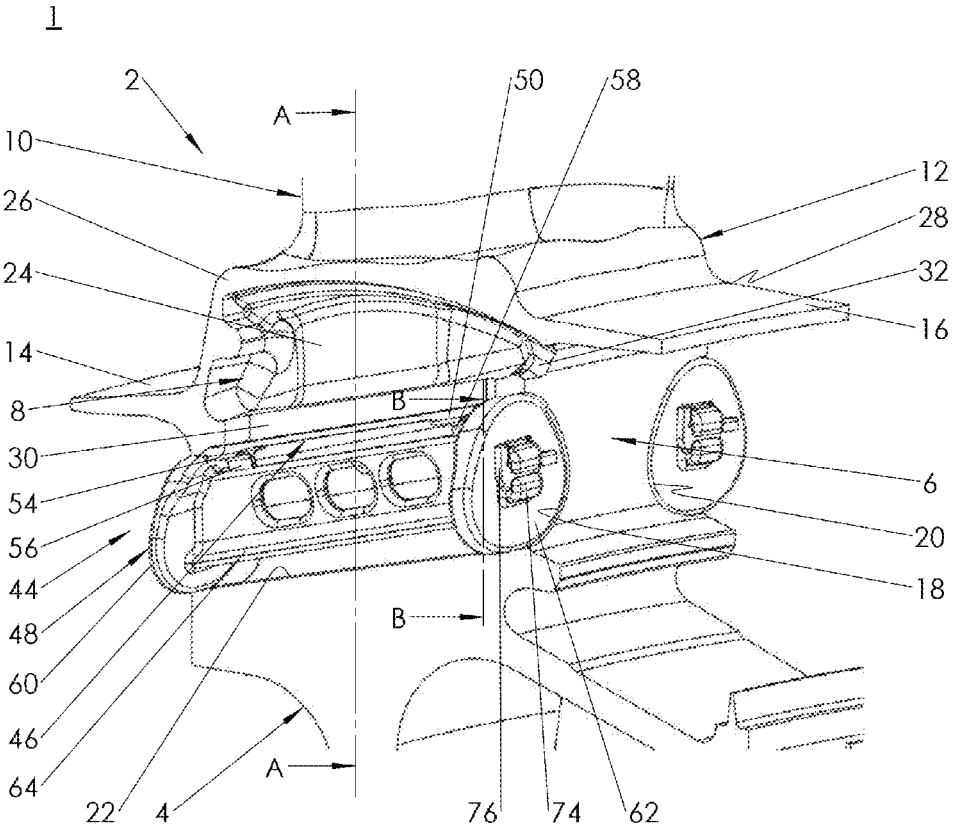
FIG. 1 shows a section of an integrally bladed rotor basic body in the area of a moving blade having a first exemplary embodiment of a sealing device according to the present invention.
Figure 2:
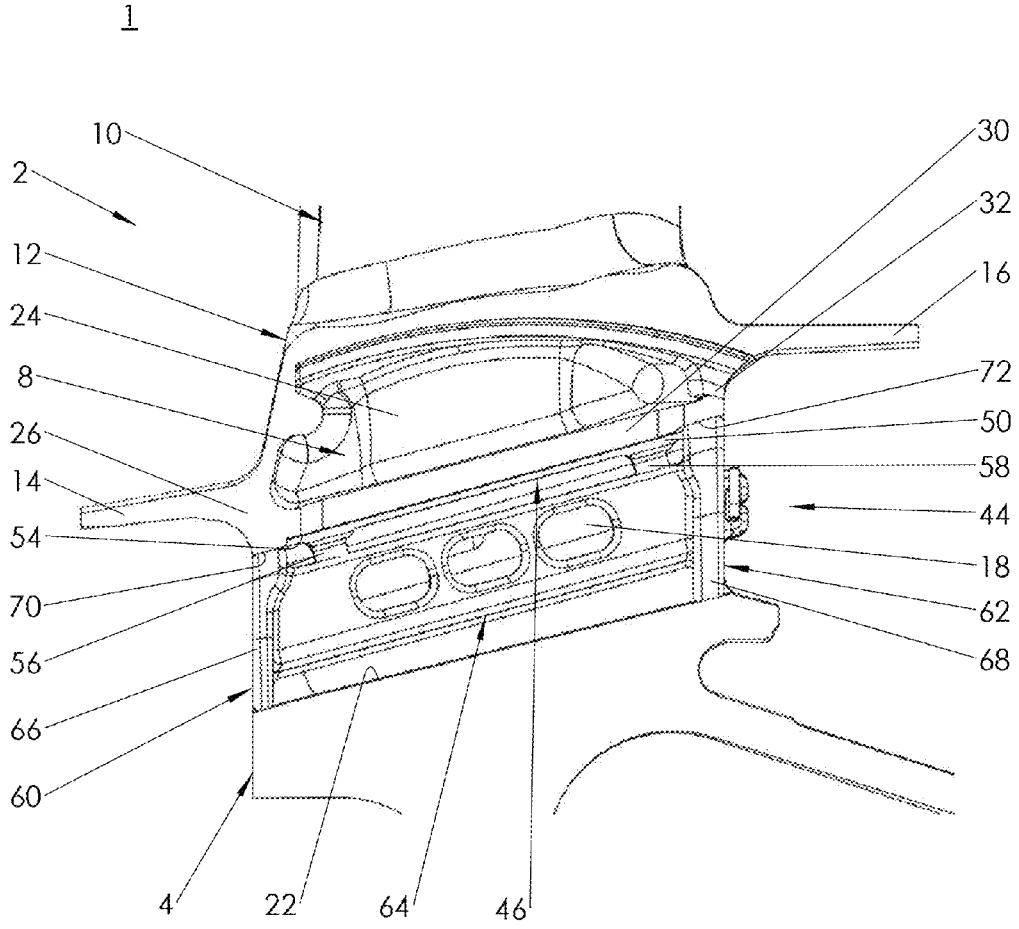
FIG. 2 shows a side view of the section from FIG. 1.

FIGS. 1 and 2 show a section of an integral rotor basic body 1 for a turbomachine such as an aircraft engine in a perspective view (FIG. 1) and in a side view (FIG. 2). Rotor basic body 1 has a plurality of moving blades 2 forming a blade row, which are attached to a turbine-side ring-shaped or disc-shaped basic body 4.

The moving blades each have a blade root 6, a blade neck 8, a blade 10, and a platform 12, situated between blade neck 8 and blade 10, having a front projection 14, viewed in the flow direction of a hot gas stream, and a rear projection 16.

Blade root 6 is designed either as an integral component of moving blades 2 or as a separately formed component which is joined later to moving blade 2. For example, it is attached in an integrally joined manner on its radial internal peripheral surface with the aid of a friction welding method to a socket of basic body 4 and has two concave side walls 18, 20, which each merge flush into a peripheral wall 22 on the basic body side.

Blade neck 8 is widened in relation to blade root 6 when viewed in the peripheral direction. It has two laterally opposing recesses 24, which are each bordered by one lateral surface 26, 28. Lateral surfaces 26, 28 each extend beyond projections 14, 16 and are provided in an area distant from the platform and an area close to the channel in each case with a setback 30 extending in the axial direction. In the area of rear projections 16, lateral surfaces 26, 28 are each provided with a setback 32 extending in the peripheral direction to produce a fluid connection between the cavity and a low-pressure side of moving blade 2.

Blade 10 is of a conventional type, so that a detailed explanation will be dispensed with. Fundamentally, it may be provided with an internal cooling system (cf. FIG. 5).

Figure 3:
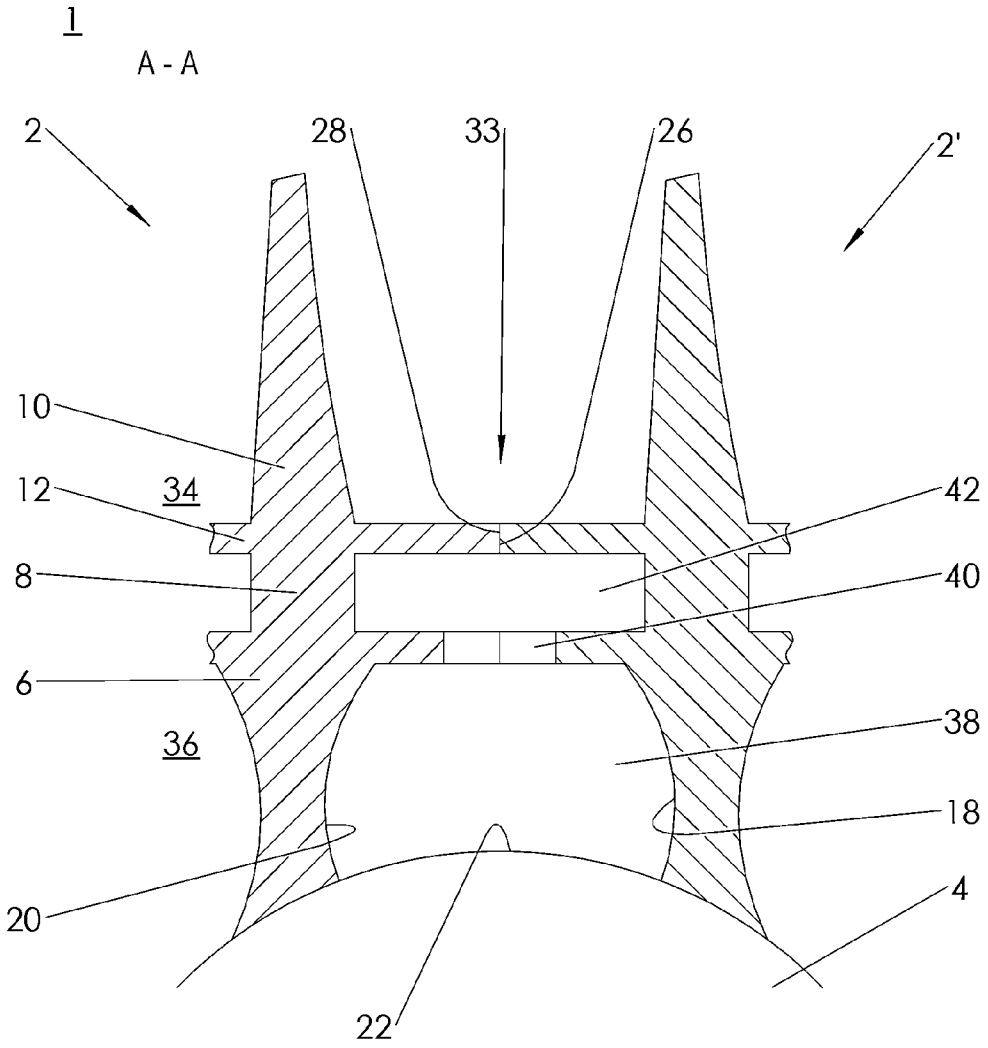
FIG. 3 shows a section through two adjacent moving blades.

As shown in the highly simplified section in FIG. 3 along line A-A shown in FIG. 1, adjacent moving blades 2, 2' each form a lateral contact area 33. Adjacent moving blades 2, 2' touch one another on their opposing lateral surfaces 26, 28 and form a ring chamber 34 on the hot gas flow side and a cooling chamber 36 on the cooling air stream side with their platforms 12, which extend beyond projections 14, 16. Opposing side walls 18, 20 of moving blades 2, 2' each delimit in the peripheral direction a channel 38 angled with respect to the rotational axis having a high-pressure-side radial internal inlet and a low-pressure-side radial external outlet, which has a radial fluid connection via a gap 40 formed by setbacks 30 with a cavity 42 formed by opposing recesses 24 (See FIG. 1). Particular opposing setbacks 32, which extend in the peripheral direction and are not visible in the sectional view, of moving blades 2, 2' each form a low-pressure-side outlet communicating with cooling chamber 36 in the axial direction.

In order to prevent a gas exchange in the radial direction between the hot gas stream and the cooling air stream through contact area 33 and in particular between channels 38 and cavities 42 through gap 40, as shown in FIGS. 1 and 2, a sealing device 44 is provided, including a plurality of strip-like sealing elements 46 activatable by centrifugal force and including a plurality of support bodies 48 for positioning sealing elements 46 in channels 38.

Figure 4:
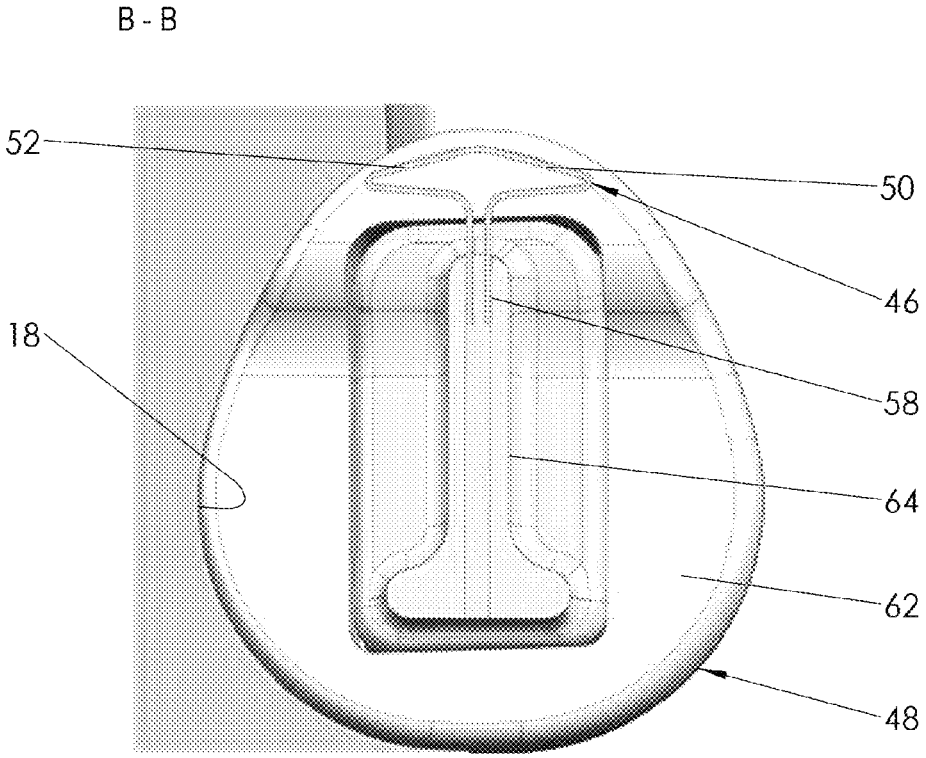
FIG. 4 shows a partial section through the moving blade of the sealing device from FIG. 1.

Sealing elements 46 each have two sealing surfaces 50, 52 (see FIG. 4) for the planar bridging of particular gap 40 having a course slightly curved concavely outward essentially in the longitudinal direction or axial direction. Sealing surfaces 50, 52 are inclined like a roof toward one another and have an edge-side overlap area with a wall section 54 of channels 38 enclosing particular gap 40 (see FIGS. 1 and 2). For the mounting and guiding in support bodies 48, sealing elements 46 each have two terminal root sections 56, 58 (See FIG. 1), using which they are received loosely, i.e., movable in the radial direction, in receptacles of support body 48.

Sealing elements 46 are fundamentally a reshaped sheet-type body, whose edge areas, which were formerly located at a distance and extend in the longitudinal direction, form root sections 56, 58 in sections. To allow an elastic deformation of sealing elements 46 upon application of centrifugal force, the edge area sections, which were previously at a distance from one another and are now located adjacent to one another, of each root section 56, 58 are not brought together, so that root sections 56, 58 are opened and sealing element 46 has an open profile. In this way, sealing surfaces 50, 52 may adapt themselves close to the contour of wall section 54, whereby a large-area overlap area is achieved and therefore a high level of tightness or seal of gap 40 is achieved.

Support bodies 48 each have a dumbbell-shaped design having two terminal support discs 60, 62, which are connected to one another via a support arm 64. They are preferably activatable by centrifugal force and additionally act using their support discs 60, 62 as an axial sealing body for reducing an axial cooling air stream through channels 38 from the high-pressure side to the low-pressure side.

Support discs 60, 62 are plate-shaped bodies having a cross section corresponding to the channel cross section. As shown in FIG. 2, they each have an outer peripheral support surface 66, 68 for contact on corresponding inner peripheral surface sections 70, 72 of channels 38.

Support arm 64 forms the receptacles for root sections 56, 58 and is fixedly connected with its end section to support disc 60. As numbered in FIG. 1, it is guided with its free end section 74 through a passage of free support disc 62 and detachably connected thereto with the aid of a locking element 76. The installation of support bodies 48 takes place in channels 38, support discs 60 having attached support arm 64 being initially positioned in channels 38 and then free support discs 62 being plugged on to the free end sections of support arm 64. Free support discs 62 are then secured on the end sections with the aid of locking elements 76.

During operation, sealing elements 46 are pressed radially outward against wall section 54 because of the centrifugal force, whereby gaps 40 are closed. Simultaneously or independently of the movement of sealing element 46, support bodies 48 are moved radially outward along the inclined channel axis because of the centrifugal force, until they press with their support surfaces 66, 68 against channel-side inner peripheral surface sections 70, 72 and thus at least reduce a particular axial flow through channels 38.

Figure 5:
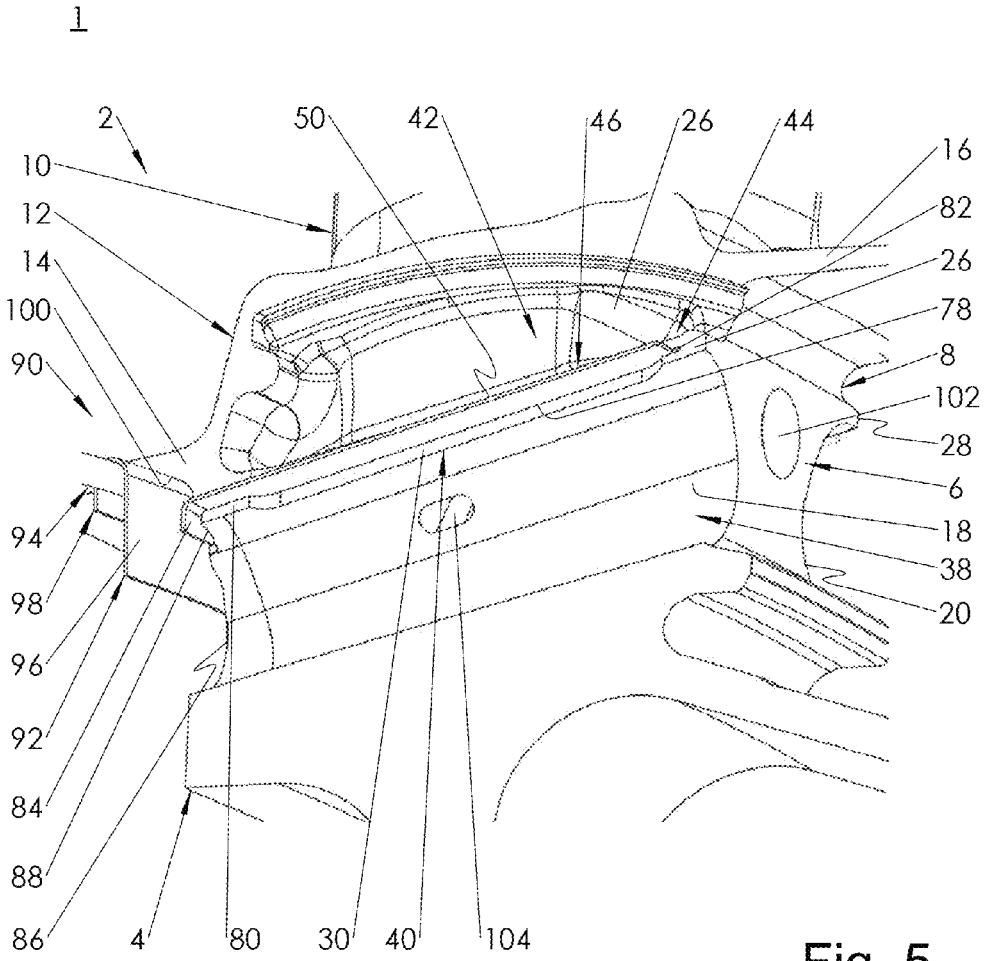
FIG. 5 shows a section of an integrally bladed rotor basic body in the area of a moving blade having a second exemplary embodiment of the sealing device according to the present invention.

FIG. 5 shows a second exemplary embodiment of a sealing device 44 according to the present invention for closing a gap 40 in each case in a contact area 33 of adjacent moving blades 2, 2' of an integrally bladed rotor basic body 1 between a radial internal, essentially axial channel 38 on the blade root side and a radial external cavity 42 (see also FIG. 3).

Sealing device 44 has a plurality of strip-like sealing elements 46 activatable by centrifugal force, each having a level sealing surface 50 extending in the longitudinal direction. Half of each sealing element 46 is accommodated in an integral slot 78 of moving blades 2. Slots 78 are formed in opposing lateral surfaces 26, 28 of blade neck 8 and extend beyond a setback 30, which extends essentially in the axial direction and is positioned radially internally, close to the channel, and distant from the platform. With an opposing slot 78 of an adjacent moving blade 2, they form in each case a pocket having a radial internal opening 80 and a radial external closed base 82. For better handling ability, sealing elements 46 have a hooked end section 84, which is accommodated in a corresponding setback 88 to form a level low-pressure-side front face 86.

During operation, sealing elements 46 are pressed radially outward into the pockets because of the centrifugal force and seal gaps 40 using their particular sealing surface 50.

In order to prevent sealing elements 46 from falling out of the pockets, in particular at a standstill, a securing device 90 is provided on the opening side having a securing element 92 and a clamping element 94.

Securing element 92 has a delimitation section 96 extending in the radial direction, using which it is in planar contact on front face 86 in the installed state, and a curved end section 98 for accommodating clamping element 94. To simplify the installation, it may include a plurality of ring segments.

Clamping element 94 is a clamping ring, preferably having a circular cross section.

To accommodate or position securing device 90, moving blades 2 have an inner peripheral groove 100 in the area of their particular front projection 14, in which securing element 92 is inserted with its curved end section 98 and against whose base groove it is pre-tensioned radially outward with the aid of clamping element 94.

An axial passage 102 is formed in each of blade roots 6 to feed cooling air into an internal cooling system of blades 10. In addition, cooling air may flow into the internal cooling system through holes 104 introduced around the periphery into side walls 18, 20 of blade root 6.

A sealing device is disclosed for an integrally bladed rotor basic body of a turbomachine for suppressing a gas exchange between a hot gas stream and a cooling air stream in the radial direction in contact areas of adjacent moving blades including a plurality of sealing elements activatable by centrifugal force, which may be situated in the area of channels which extend from a high-pressure side to a low-pressure side and are delimited around the periphery by the moving blades, an integrally bladed rotor basic body having such a sealing device, and a turbomachine having such an integrally bladed rotor basic body.

LIST OF REFERENCE NUMERALS

1 rotor basic body
2 moving blade
4 basic body
6 blade root
8 blade neck
10 blade
12 platform
14 front projection
16 rear projection
18 side wall
20 side wall
22 peripheral wall
24 recess
26 lateral surface
28 lateral surface
30 setback extending in the axial direction
32 setback extending in the peripheral direction
33 contact area
34 ring chamber
36 cooling chamber
38 channel
40 gap
42 cavity
44 sealing device
46 sealing element
48 support body
50 sealing surface
52 scaling surface
54 wall section
56 root section
58 root section
60 support disc
62 support disc
64 support arm
66 support surface
68 support surface
70 inner peripheral surface section
72 inner peripheral surface section
74 end section
76 locking element
78 slot
80 opening
82 base
84 end section
86 front face

88 setback
90 securing device
92 securing element
94 clamping element
96 delimitation section
98 end section
100 inner peripheral groove
102 passage
104 hole

What is claimed is:

1. A sealing device for an integrally bladed rotor basic body of a turbomachine for suppressing a gas exchange between a hot gas stream and a cooling air stream in a radial direction in lateral contact areas of adjacent moving blades, the sealing device comprising:

a plurality of sealing elements activatable by centrifugal force and situatable in an area of channels extending from a high-pressure side to a low-pressure side and peripherally delimited by the moving blades; and support bodies positioned within the channels;

the sealing elements each having at least one root section received loosely, so as to be movable in a radial direction, in receptacles of the support bodies;

the sealing elements each having an open profile.

2. The sealing device as recited in claim 1 wherein the sealing elements each have a rectangular cross section having a level sealing surface extending in a longitudinal direction.

3. The sealing device as recited in claim 1 wherein the sealing elements have head-side sealing surfaces inclined toward one another in a transverse direction.

4. The sealing device as recited in claim 3 wherein the sealing surfaces are concavely curved in the longitudinal direction.

5. The sealing device as recited in claim 3 wherein the sealing elements are elastically deformable under application of the centrifugal force.

6. The sealing device as recited in claim 3 wherein the support bodies are provided for positioning the sealing elements and the sealing elements are movably accommodated in the support bodies using at least one body section.

7. The sealing device as recited in claim 6 wherein the support bodies are axial sealing bodies.

8. An integrally bladed rotor basic body for a turbomachine comprising:

a plurality of moving blades; and a sealing device for an integrally bladed rotor basic body of a turbomachine for suppressing a gas exchange between a hot gas stream and a cooling air stream in a radial direction in lateral contact areas of adjacent moving blades, the sealing device comprising:

a plurality of sealing elements activatable by centrifugal force and situatable in an area of channels extending from a high-pressure side to a low-pressure side and peripherally delimited by the moving blades;

wherein the sealing elements are each accommodated in a pocket formed by opposing depressions of adjacent moving blades and extending parallel to the channel axis; wherein the pockets each have a radial internal opening and a radial external base; wherein the sealing elements are secured against falling out of the pockets by a securing device in the area of the openings; and wherein the securing device has a securing element extending in the peripheral direction as an axial stop for the sealing elements and a clamping element extending in the peripheral direction and fixing the securing element.

9. The integrally bladed rotor basic body as recited in claim 8 wherein the securing element is inserted with a curved end section into an inner peripheral groove formed by the moving blades and is fixed in place therein via the clamping element.

10. The integrally bladed rotor basic body as recited in claim 8 wherein the sealing elements are situated via support bodies in the channels.

11. A turbomachine comprising the integrally bladed rotor basic body as recited in claim 8.

12. An integrally bladed rotor basic body for a turbomachine comprising:

a plurality of moving blades; and a sealing device as recited in claim 1.

13. A turbomachine comprising the integrally bladed rotor basic body as recited in claim 12.

* * * * *